US009398791B1

(12) United States Patent
Slowinski

(10) Patent No.: US 9,398,791 B1
(45) Date of Patent: Jul. 26, 2016

(54) DIAMOND CUTS PROVIDING INCREASED LIGHT AMPLIFICATION

(71) Applicant: Christopher Slowinski, Lake Success, NY (US)

(72) Inventor: Christopher Slowinski, Lake Success, NY (US)

(73) Assignee: ECNA, LLC

( * ) Notice: Subject to any disclaimer, the term of this patent is extended or adjusted under 35 U.S.C. 154(b) by 0 days.

(21) Appl. No.: 14/604,955

(22) Filed: Jan. 26, 2015

(51) Int. Cl.
*A44C 17/00* (2006.01)

(52) U.S. Cl.
CPC ..... *A44C 17/00* (2013.01)

(58) Field of Classification Search
CPC ..... A44C 17/00; A44C 17/001; A44C 17/007
USPC ..... 63/32, 26–2, 29.1–29.2, 30–31
See application file for complete search history.

(56) References Cited

U.S. PATENT DOCUMENTS 6,449,985 B1 * 9/2002 Kejejian ..... A44C 17/001 63/32
2007/0186586 A1 * 8/2007 Matsumura ..... A44C 17/001 63/32
2011/0041554 A1 * 2/2011 Zaveri ..... A44C 17/002 63/28
2012/0079853 A1 4/2012 Blasbichler et al.
2012/0096898 A1 * 4/2012 van Looveren ..... A44C 17/001 63/32
2015/0020544 A1 1/2015 Rydlewicz

FOREIGN PATENT DOCUMENTS

JP 2005095280 A 4/2005
RU 2363363 C2 8/2009

OTHER PUBLICATIONS

International Search Report dated Jan. 14, 2016 issued in connection with corresponding PCT/US2015/051173.

* cited by examiner

*Primary Examiner* — Abigail Morrell
(74) *Attorney, Agent, or Firm* — Ostrolenk Faber LLP

(57) ABSTRACT

A sparkling, oblong-shaped precious stone, such as an emerald or cushion cut diamond is formed by providing these diamonds with two long crown surfaces extending at a crown angle and two long pavilion surfaces extending at a pavilion angle, where the crown angle is in the range of 30-36 and the pavilion angle is in the range of 30-34. The crown angle and the pavilion angle are so formed that the crown angle is either equal to or larger than the pavilion angle by an angle that does not exceed 6 degrees.

14 Claims, 4 Drawing Sheets

Fig. 1
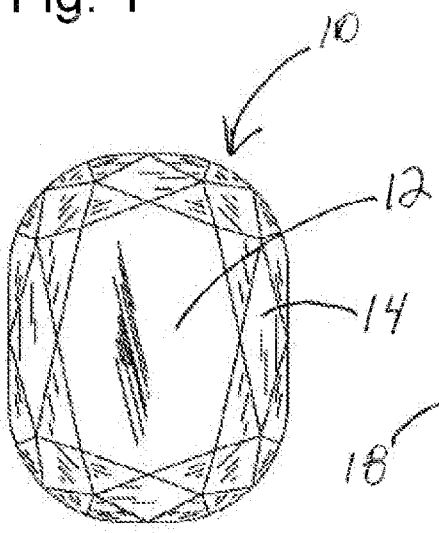
Fig. 2
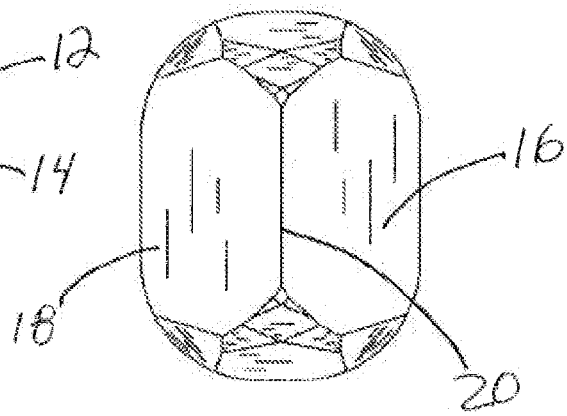
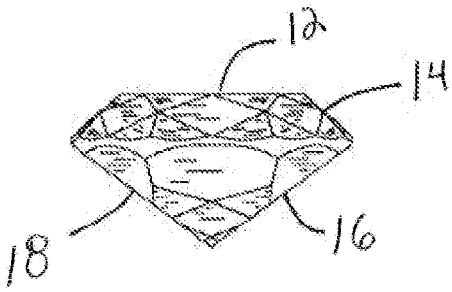
Fig. 3
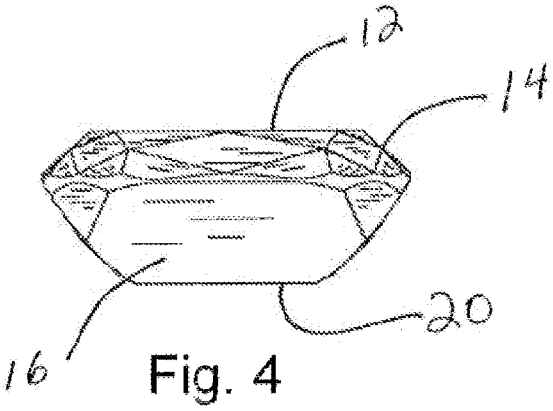
Fig. 4

DIAMOND CUTS PROVIDING INCREASED LIGHT AMPLIFICATION

BACKGROUND OF THE INVENTION

The present invention is generally directed to gemstones and, more particularly, to non-round gemstones, preferably diamonds, having a unique cut that produces greater light amplification at the crown and table surfaces thereof.

The original round, brilliant-cut was developed by Marcel Tolkowsky in 1919. The round brilliant consists of 58 facets and is widely popular. In more recent years, non-round diamond shapes have come into vogue. The present invention is focused on non-round diamond cuts, such as those that are known as the emerald, cushion and radiant cuts. But the disclosure herein is also applicable to other oblong shapes, such as the marquis and oval cuts. It may even be applied to the asscher and princess cuts as well. The unique look of the emerald cut diamonds is created by the "step cuts" of its pavilion and its large, open table. Instead of the sparkle of the brilliant cut, emerald cut diamonds produce a hall-of-reflection-mirrors effect, with an interplay of light and dark planes. While less fiery, the long lines and dramatic flashes of light give the emerald cut an elegant appeal.

The present invention builds and improves upon the specially-shaped emerald diamond shown in the present inventor's issued U.S. Design Pat. No. D698,278, the contents of which are incorporated herein by reference.

As is well known, emerald and cushion cut diamonds have associated therewith certain parameters. These parameters include the crown angle, the crown height percentage, the girdle height percentage, the pavilion angle, the table percentage and the total depth percentage. Conventionally, the crown angle for an emerald cut is in the range of 35-36°. The pavilion angle is in the range of 40-41.5°. The total depth percentage is conventionally in the range of 60-70%.

As could be appreciated from the foregoing, emerald cut diamonds do not provide the brilliance and light reflecting experience which is the hallmark of the round, brilliant cut stones. The diamond trade has invested enormous efforts in searching for and attempting to find cuts that would increase the brilliance of oblong gemstones such as the emerald and cushion cut stones.

SUMMARY OF THE INVENTION

It is an object of the present invention to provide oblong gemstone shapes that are more sparkling.

It is another object of the invention to provide oblong shaped gemstones, particularly diamonds, that provide greater light reflection amplification.

The foregoing and other objects of the invention are realized by an oblong precious stone that includes: a table having a table plane; a first long crown surface extending at a predetermined crown angle to the table plane; a second long crown surface opposed to the first long crown surface and extending at said crown angle relative to the table plane; a first long pavilion surface extending at a predetermined pavilion angle relative to the table plane; a second long pavilion surface extending oppositely to the first long pavilion surface and extending at said predetermined pavilion angle relative to the table plane; wherein said predetermined crown angle is in the range of 30-36 and wherein said pavilion angle is in the range of 30-34; and wherein said predetermined crown angle and said pavilion angle are so formed that the predetermined crown angle is either equal to or larger than said pavilion angle by an angle that does not exceed 6 degrees.

Preferably, the precious stone has a crown angle in the range of 31-34; a crown height percentage of 8-13; a girdle height percentage of 3.5-4.5; a pavilion angle in the range of 31-33; a table percentage in the range of 72-77 and a total depth percentage in the range of 40-50.

Other features and advantages of the present invention will become apparent from the following description of the invention which refers to the accompanying drawings.

BRIEF DESCRIPTION OF THE DRAWINGS

FIG. 1 is a top view of an emerald stone in accordance with the present invention.

FIG. 2 is a bottom view of an emerald stone in accordance with the present invention.

FIG. 3 is an end view of an emerald stone in accordance with the present invention.

FIG. 4 is a side view of an emerald stone in accordance with the present invention.

DETAILED DESCRIPTION OF EMBODIMENTS OF THE INVENTION

Figure 5:
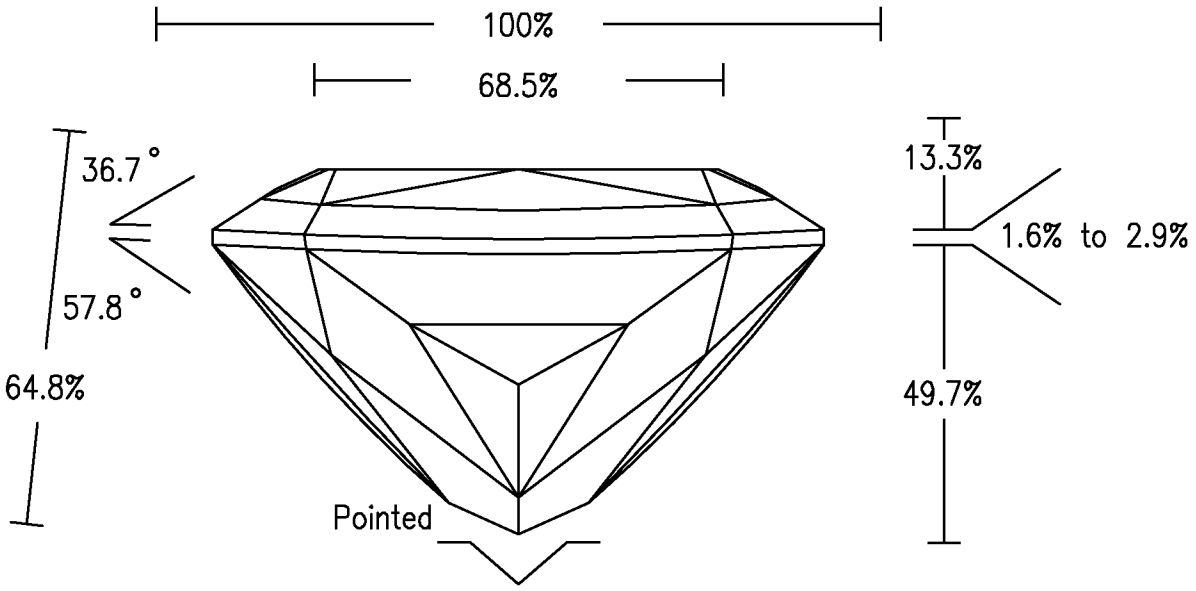
FIG. 5 (Prior Art)
FIG. 5 shows parameters of a conventional emerald cut stone indicating the values of the crown angle, crown height percentage, pavilion angle, table percentage and total depth percentage.

Referring to FIGS. 1-4, one can note the cushion-cut diamond 10 in FIG. 1, its table 12, crown 14 extending adjacently to the table and left and right side oblong pavilions 16, 18 extending adjacently to the oblong pavilion, the pavilion meeting at a culet-like line 20. FIG. 3 shows that the oblong pavilions 16, 18 extending at a distinct pavilion angle relative to the table surface (or to a line passing through the girdle) of the precious stone. Similarly, the crown angle is also indicated, although it is noted that the crown angle is more definitively provided in an emerald cut diamond.

In marked departure from the prior art, the instant inventor has discovered that a brilliant-like reflection pattern can be obtained by providing an emerald cut stone with a very shallow underside, namely by forming the pavilion angles in the range of 30 to 34 degrees, preferably 31 to 33 degrees, as opposed to the conventional pavilion angles which are in the range of 40 to 41.5 degrees. Furthermore, unlike the total depth percentage which is conventionally in the range of 60 to 70 percent, the present invention realizes its unexpectedly improved brilliance and light amplification characteristics by setting the total depth percentage in a range from 36.00 to 57.00. The crown angle is preferably from 30 to 36 degrees.

The realization of the unexpected brilliance of the diamond cut herein described is also dependent on assuring that the pavilion angle is equal to or smaller by up to 6 degrees, as compared to the crown angle.

The table below provides the relevant parameters for an emerald cut diamond, indicating in each instance a minimum value, a maximum value and a preferred range.

ANGLE AND PERCENTAGE PARAMETERS FOR EMERALD CUT DIAMOND

| PARAMETER | MINIMUM | PREFERRED RANGE | MAXIMUM |
|---|---|---|---|
| Crown Angle° | 30 | 30-33 | 36 |
| Crown Height % | 6 | 8-13 | 15 |
| Girdle Height % | 3 | 3.5-4.5 | 5 |
| Pavilion Angle° | 30 | 31-33 | 34 |
| Table % | 70 | 72-77 | 79 |
| Total Depth % | 36 | 40-50 | 57 |

Additional criteria of the foregoing is that the pavilion angle is 6° or less than the crown angle. In other words, the pavilion angle≤6° crown angle.

Figure 6:
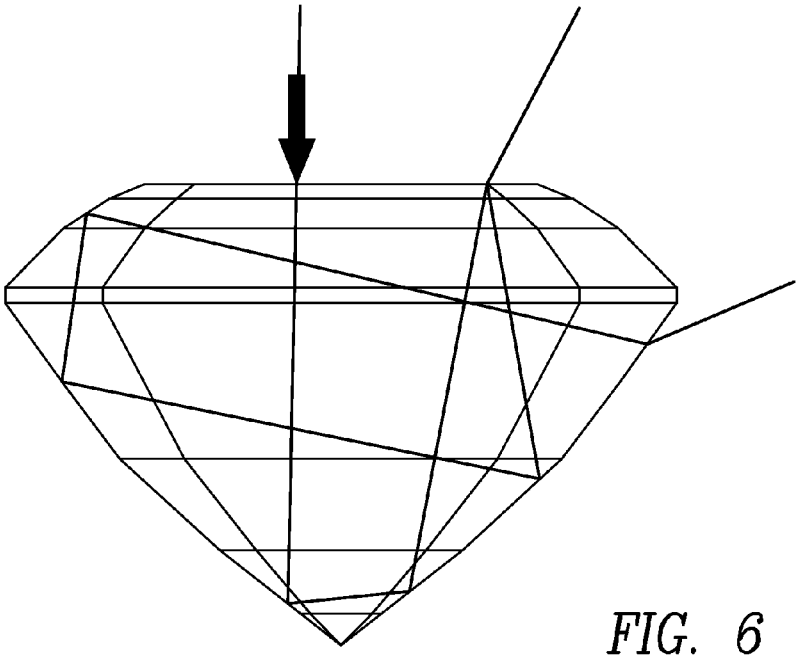
FIG. 6 (Prior Art)
FIG. 6 is a light reflection diagram for a conventional emerald cut stone.
Figure 7:
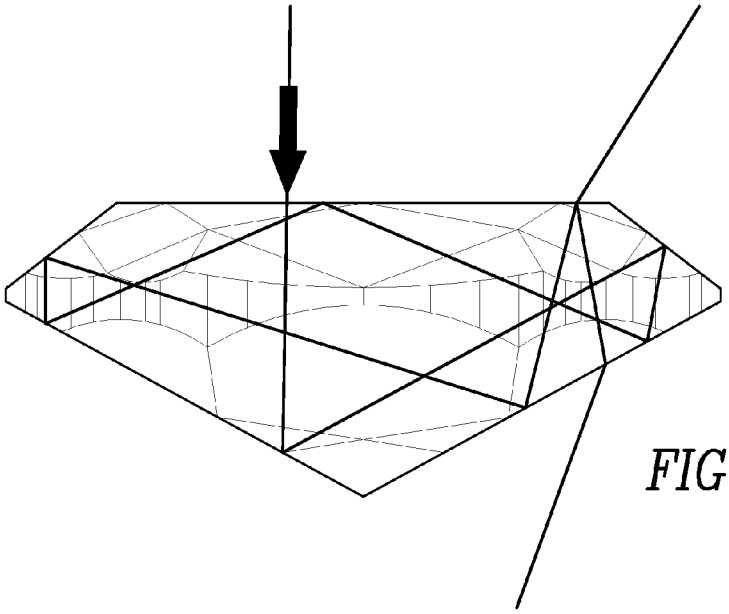
FIG. 7 is a light reflection diagram for the emerald cut and other stone cuts in accordance with the present invention.

By adhering to the criteria set forth in the above table, and with reference to FIGS. 6 and 7, one can compare the light reflection pattern, which has actually been measured for a gemstone embodiment of the invention, and so note in the conventional gemstone, a ray of light that strikes the table perpendicularly hits the pavilion at one side, is then reflected to the opposed pavilion side and eventually reflected back out through the table with only a small portion of the light traversing the volume between the different surfaces, none of which is the table.

In marked contrast to the prior art, the light pattern for an emerald stone in accordance with the present invention, follows a path whereby light is reflected from one pavilion surface to an opposed crown surface, then to the other pavilion surface, then to the table, then back to the pavilion surface, then to the crown, then to the opposed pavilion and only then out to the table. This light pattern, with light rays being repeatedly reflected and refracted between many diamond surfaces creates an extremely brilliant light display that has been very well received and appreciated by those who have seen it.

Figure 8:
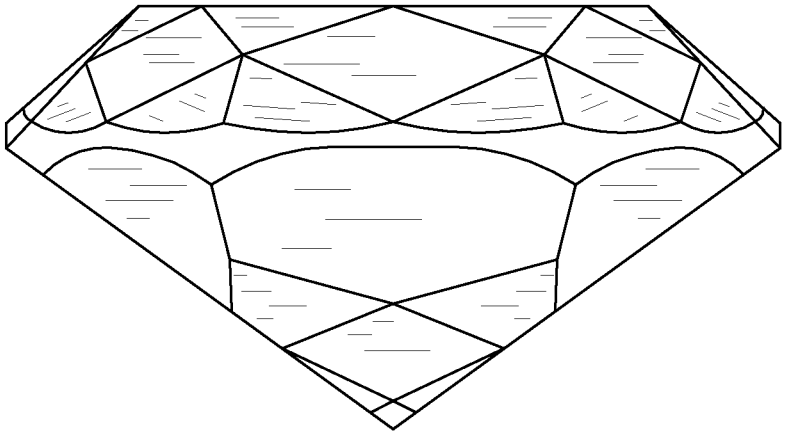
FIG. 8 replicates FIG. 3 and is annotated with the various parameters thereof.

In FIG. 3, the crown angle is indicated to be (for a conventional emerald stone) 36.7°. The pavilion angle is shown to be at 57.8°. The total depth percentage is 64.8% and is calculated as the ratio of the height divided by the width of the stone. The table percentage (68.5%) is calculated relative to the entire width of the stone measured across the oblong pavilion surfaces, i.e., across the length of the stone. The corresponding values for the stone of the present invention (FIG. 8) are set forth in the tabulation above. As can be discerned from FIGS. 1, 2 and 4, the overall stone shape is substantially rectangular and therefore the mentioned crown and pavilion surfaces lengths are substantially those of the table length.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An oblong precious stone elongated in one direction and defining a length of the precious stone in said one direction and a width in a direction perpendicular to said one direction, the precious stone having a left side and a right side both of which extend along the length of the stone, the precious stone comprising:

a table having a table plane, elongated in the one direction, a girdle, and said precious stone having a shape and configuration that results in a specific total depth percentage, a specific crown height percentage, a specific girdle height percentage and a specific table percentage;

a first crown surface, elongated in the one direction and extending at the left side of the stone and located between the table and the girdle and extending at a crown angle to the table plane;

a second crown surface, elongated in the one direction and extending at the right side of the stone and located between the table and the girdle and opposed to the first crown surface and extending at said crown angle relative to the table plane;

a first pavilion surface, elongated in the one direction and extending at the left side of the stone and at a pavilion angle relative to the table plane;

a second pavilion surface, elongated in the one direction and extending at the right side of the stone and extending oppositely to the first pavilion surface and extending at said pavilion angle relative to the table plane;

wherein said crown angle is in the range of 30-36 degrees and wherein said pavilion angle is in the range of 30-34 degrees; and wherein said crown angle and said pavilion angle are so formed that the crown angle is either equal to or larger than said pavilion angle by an angle that does not exceed 6 degrees, to attain increased light amplification.

2. The precious stone of claim 1, wherein said total depth percentage is in the range of 36.00 to 57.00.

3. The precious stone of claim 1, wherein the total depth percentage is in the range of 40 to 50.

4. The precious stone of claim 1, wherein said crown angle is in the range of 31-34 degrees.

5. The precious stone of claim 1, wherein said pavilion angle is in the range of 31 to 33 degrees.

6. The precious stone of claim 1, wherein said precious stone is a diamond.

7. The precious stone of claim 1, wherein said precious stone has a cushion-cut shape.

8. The precious stone of claim 1, wherein said precious stone has an emerald-cut shape.

9. The precious stone of claim 1, wherein said precious stone has a radiant shape.

10. The precious stone of claim 1, wherein said precious stone has an oval shape.

11. The precious stone of claim 1, wherein said precious stone has a marquis shape.

12. The precious stone of claim 1, wherein said precious stone has a princess shape.

13. The precious stone of claim 1, wherein said crown height percentage in the range of 6-15, said girdle height percentage in the range of 3-5, said table percentage in the range of 70-79, and said total depth percentage in the range of 36-57.

14. The precious stone of claim 13, wherein said crown height percentage is in the range of 8-13, said girdle height percentage is in the range of 3.5-4.5, said table percentage is in the range of 72-77, and said total depth percentage is in the range of 40-50.

* * * * *